United States Patent [19]

Conner, Jr.

[11] 4,044,698

[45] Aug. 30, 1977

[54] APPARATUS FOR JOINING PLIES OF MATERIAL SUCH AS TEXTILE FABRIC

[75] Inventor: William R. Conner, Jr., Shelbyville, Tenn.

[73] Assignee: Stahl-Urban Company, Brookhaven, Miss.

[21] Appl. No.: 705,897

[22] Filed: July 16, 1976

[51] Int. Cl.[2] ..... D05B 21/00

[52] U.S. Cl. ..... 112/121.12; 112/121.26; 112/153

[58] Field of Search ..... 112/121.12, 121.15, 112/121.11, 121.26, 121.29, 121.27, 203, 204, 65, 86, 90, 153

[56] References Cited

U.S. PATENT DOCUMENTS

| | | | |
|---|---|---|---|
| 3,469,545 | 9/1969 | Hale et al. | 112/121.11 |
| 3,474,747 | 10/1969 | Noiles | 112/121.15 |
| 3,636,898 | 1/1972 | Conner, Jr. | 112/203 |
| 3,670,674 | 6/1972 | Conner, Jr. | 112/121.29 |
| 3,722,437 | 3/1973 | Winberg et al. | 112/121.12 |
| 3,810,436 | 5/1974 | Marforid | 112/121.15 |
| 3,867,889 | 2/1975 | Conner, Jr. | 112/121.11 |
| 3,878,801 | 4/1975 | Conner, Jr. | 112/121.29 |

*Primary Examiner*—H. Hampton Hunter

*Attorney, Agent, or Firm*—Koenig, Senniger, Power and Leavitt

[57] ABSTRACT

Apparatus for joining together two plies of material such as textile fabric comprising a sewing machine, contour guide means for shifting the plies as they are fed forward through the sewing machine to effect contour seaming of the plies, and a feed control clamp for clamping the trailing ends of the plies as they are fed forward. This clamp, clamped on the trailing ends of the plies, moves forward with the plies as they are fed forward. It is also automatically shifted from side to side as it moves forward to maintain the edge of the plies being sewn aligned with the contour guide means. The apparatus further comprises loading means which is adapted, while a pair of plies is being sewn, to receive the next pair to be sewn and, upon completion of sewing the first pair, to enter the next pair in the sewing machine and in the feed control clamp.

29 Claims, 15 Drawing Figures

APPARATUS FOR JOINING PLIES OF MATERIAL SUCH AS TEXTILE FABRIC

BACKGROUND OF THE INVENTION

This invention relates to apparatus for forming plies of material such as textile fabric or the like, and more particularly to apparatus for sewing plies of material together with controlled loading and guidance of the plies.

In one respect, the invention involves improvements upon the Apparatus for Seaming Pieces of Textile Fabric or the Like of my prior U.S. Pat. No. 3,867,889, issued Feb. 25, 1975. In said prior patent, there is disclosed an earlier apparatus of my imvention for sewing two pieces or plies of material with the start and finish ends of the plies sewed out even and matching, and in which the starting ends of the two plies are matched and any out-of-registration conditin of the trailing ends of the plies as they are fed through the sewing machine is sensed and the relative speed of feed of the two plies through the sewing machine varied in accordance with this sensing to bring the trailing ends of the plies substantially into registration. Thus, if the upper of the two plies is longer than the lower, the apparatus senses this and increases the rate of feed of the upper ply relative to the lower ply to cause the trailing ends of the plies to come out even, taken up the excess in the length of the upper ply in effect by puckering up the upper ply.

While my said prior apparatus is quite satisfactory insofar as seam end equalization is concerned for many applications, its production rate may be lower than desired for some operations due to the fact that the loading of an item of work (e.g., a pair of plies) into the apparatus generally cannot be started until the preceding item has been completely sewn, meaning that the sewing time per item is idle time insofar as loading is concerned.

SUMMARY OF THE INVENTION

Among the several objects of this invention may be noted the provision of improved apparatus for joining plies of material such as textile fabric in which an item of work, e.g., two plies of material, may be loaded into the apparatus ready for being joined while a preceding item of work is being joined; the provision of such apparatus wherein the plies are contour seamed along an edge thereof, i.e., seamed together with the edges automatically registered as the plies are fed through the apparatus by a contour guide means; the provision of such apparatus wherein the plies are seamed by feeding them through a sewing machine to stitch the edges together; and the provision of such apparatus wherein the leading ends of the plies may be matched with one another and the trailing ends of the plies matched with one another as the plies are entered in the apparatus and maintained matched as the plies are seamed, without any out-of-registration sensing and ply speed variation.

In general, apparatus of this invention comprises means for seaming plies of material together along an edge thereof, means for feeding the plies through the seaming means, and contour guide means for shifting the plies as they are fed forward by the feeding means to effect contour seaming of the plies, with the improvement comprising the provision of means for controlling the feed of the plies, said control means comprising a control clamp for clamping the plies as they are fed forward, means mounting said clamp for movement with the plies as they are fed forward, and loading means adapted, while one assembly of plies is being fed through the seaming means, to receive the next assembly of plies to be seamed and operable upon completion of seaming the said one assembly to enter the next assembly in said seaming means and in said control clamp.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
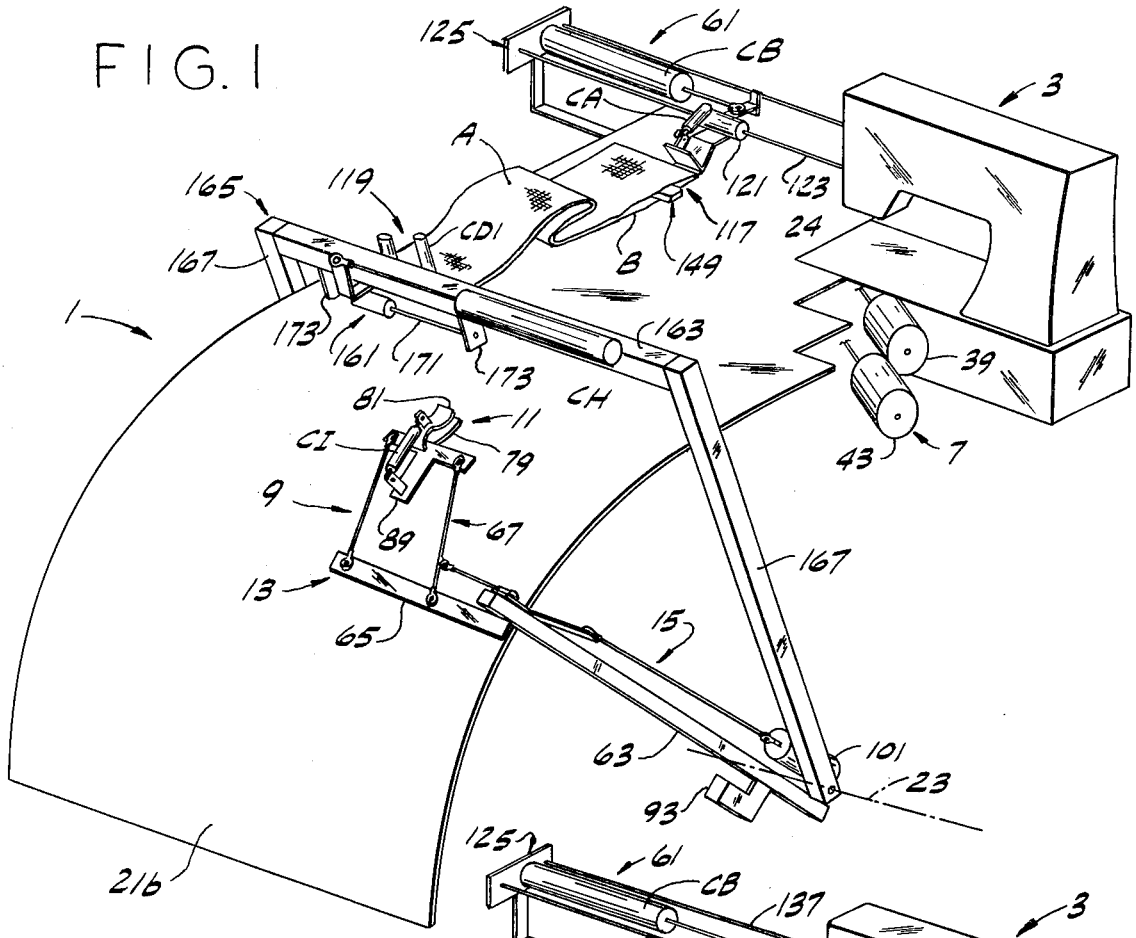
FIG. 1 is a semidiagrammatic perspective of an apparatus of this invention, showing parts in a starting position, and further showing two plies of material as they are applied to the loading means of the apparatus.
Figure 2:
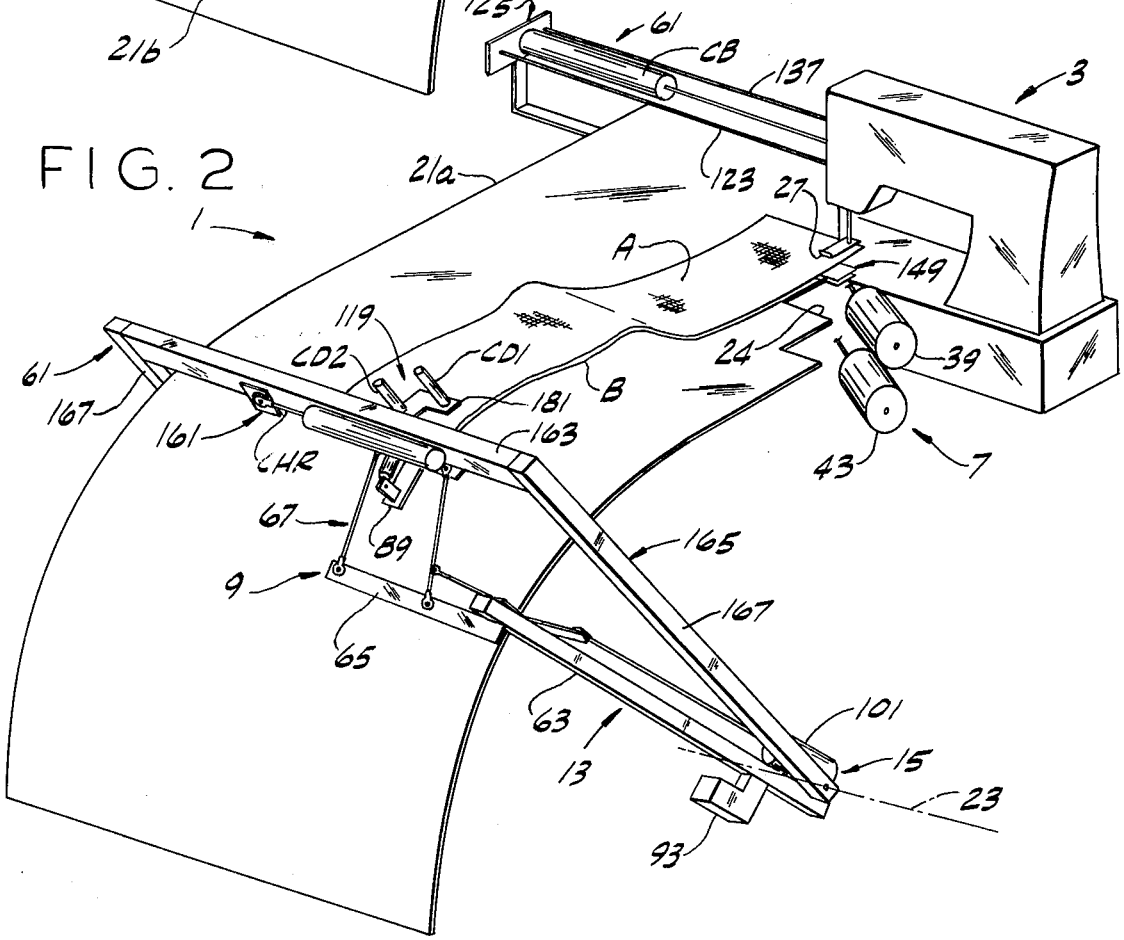
FIG. 2 is a view similar to FIG. 1 showing a stage of the loading operation wherein the leading ends of the plies are entered in the sewing machine of the apparatus and the trailing ends of the plies are entered in the control clamp of the apparatus.
Figure 3:
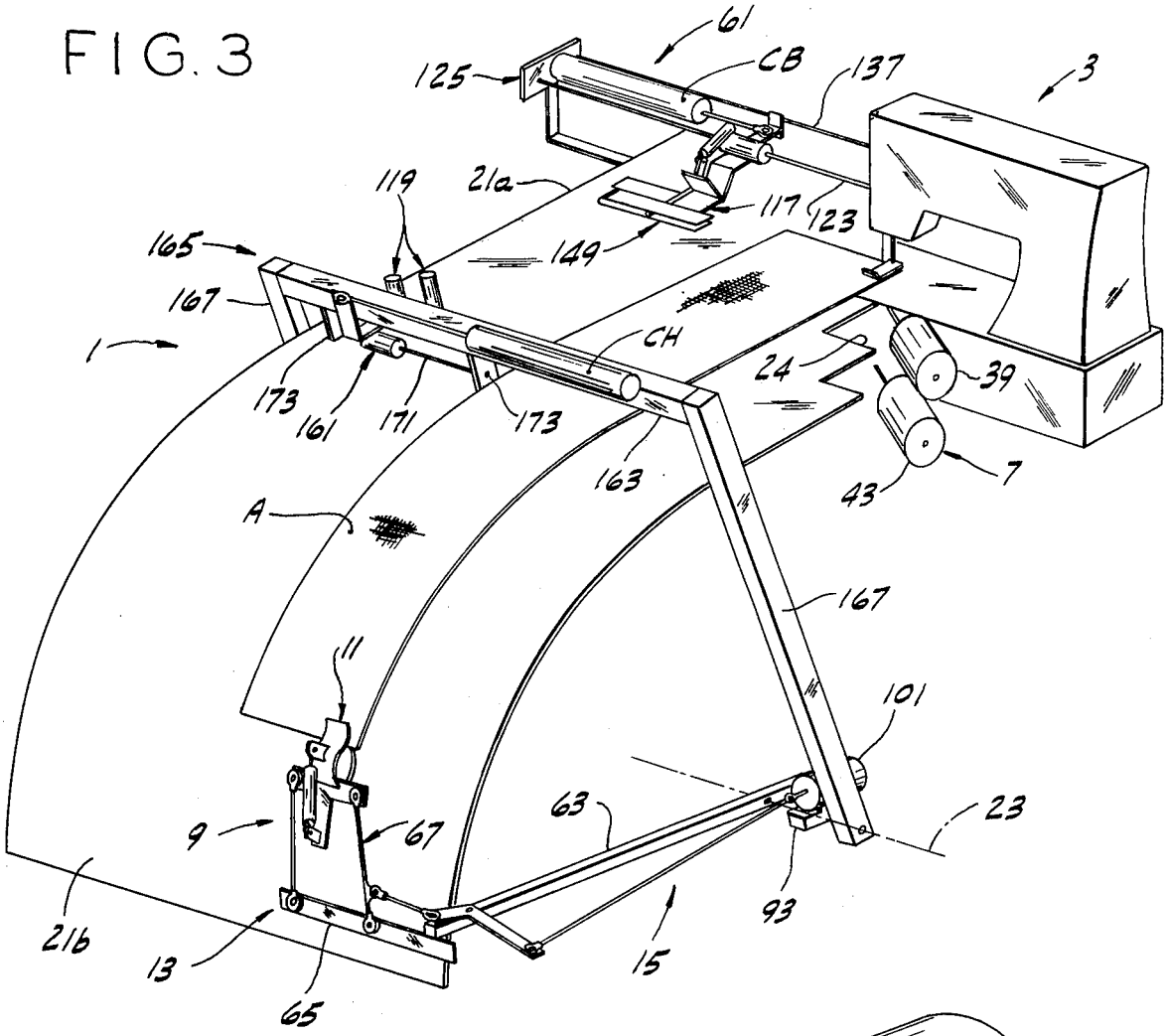
FIG. 3 is a view similar to FIG. 2 showing a further stage of the operation wherein the sewing machine is about to start the sewing of the plies and the loading means returned to starting position for receiving the next assembly of plies to be seamed.
Figure 4:
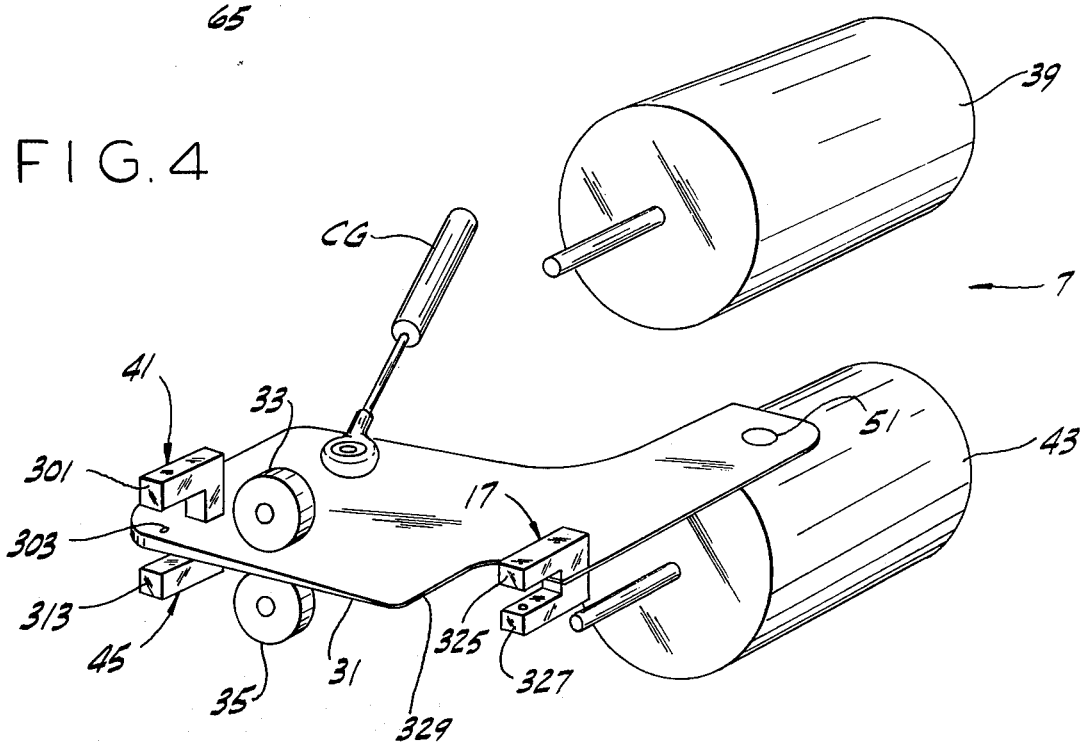
FIG. 4 is a semidiagrammatic perspective showing certain components of the contour guide means of the apparatus.
Figure 5:
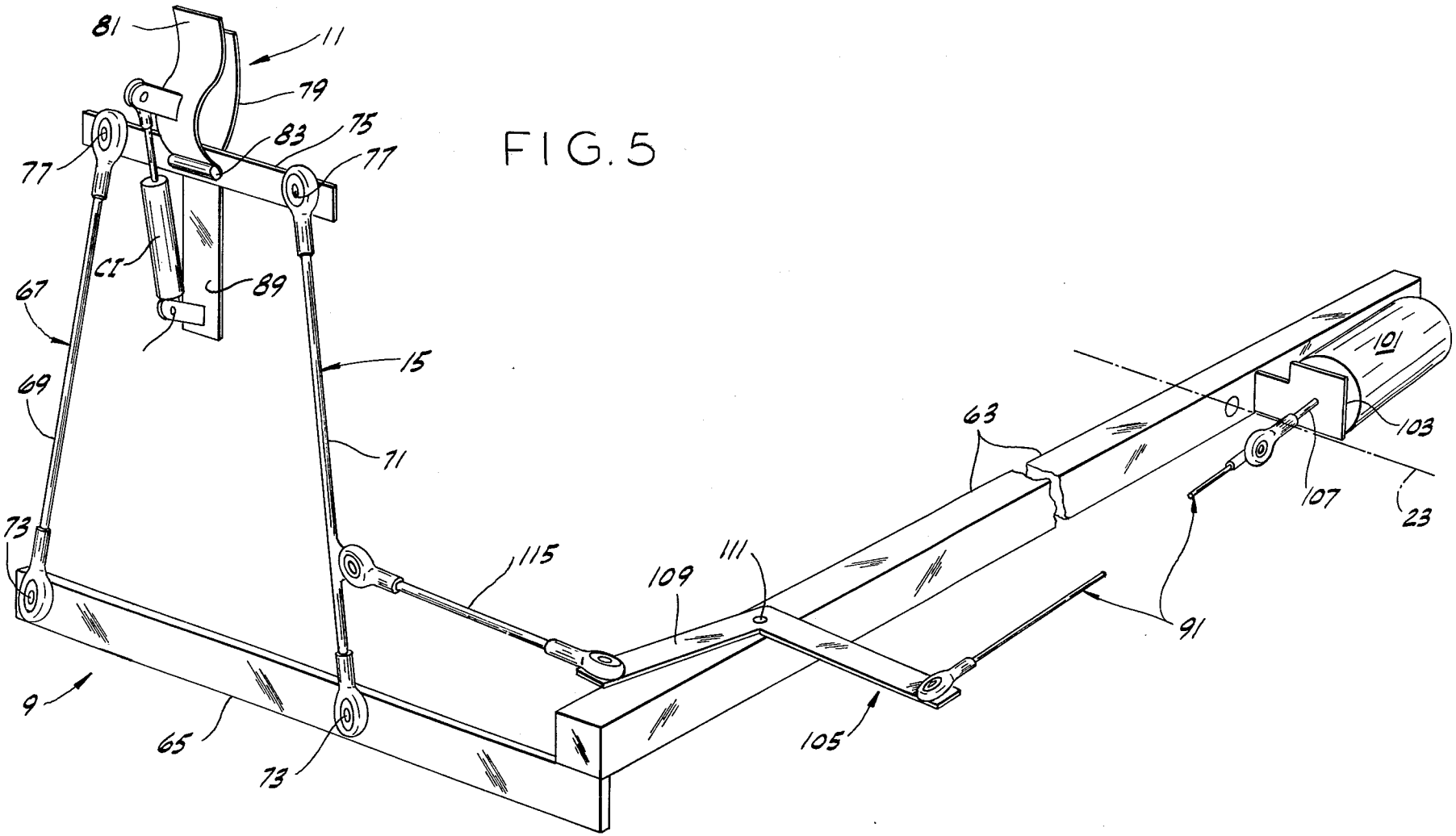
FIG. 5 is a semidiagrammatic perspective showing the control clamp of the apparatus and the mounting means and operating means therefor.
Figure 6:
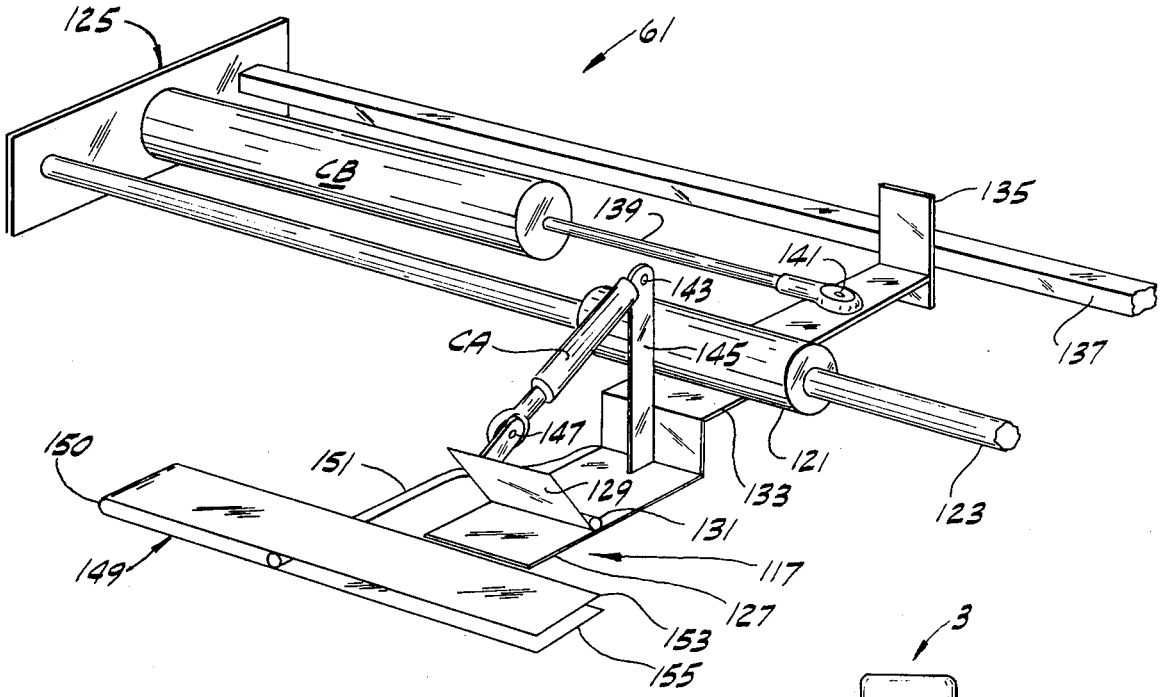
FIG. 6 is a semidiagrammatic perspective showing a first loading clamp of the apparatus and its operating mechnaism.
Figure 9:
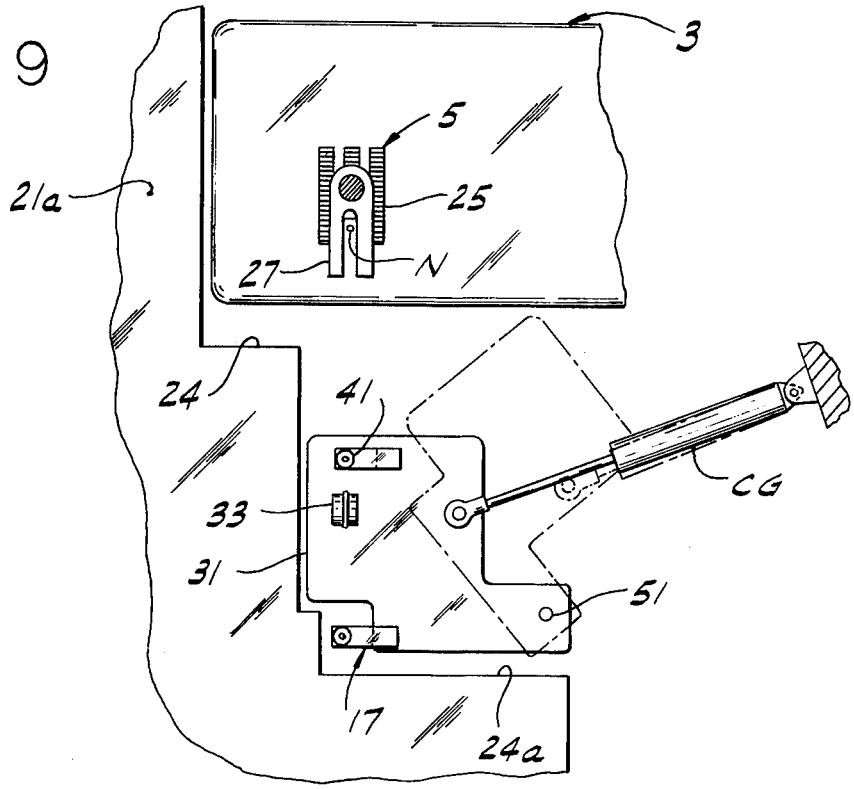
FIG. 9 is a view showing part of the sewing machine and part of the contour guide means of the apparatus.
Figure 10:
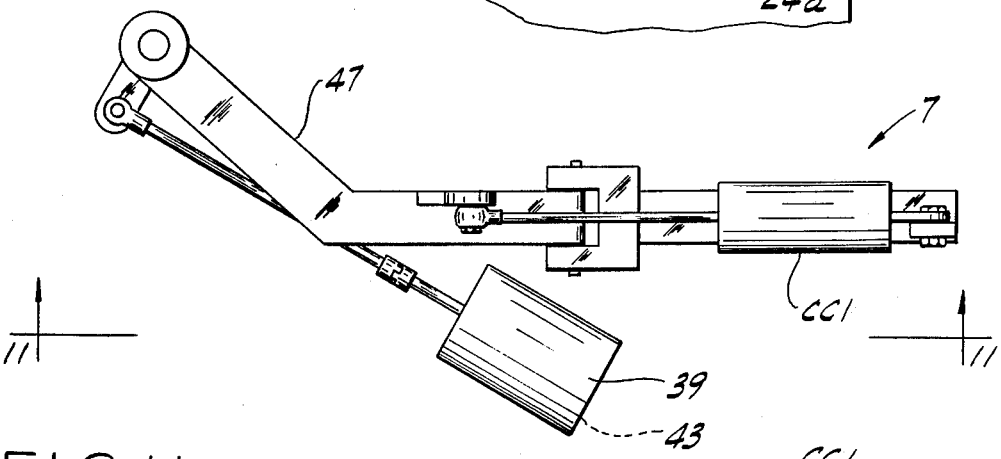
FIG. 10 is a plan showing parts of the contour guide means.
Figure 11:
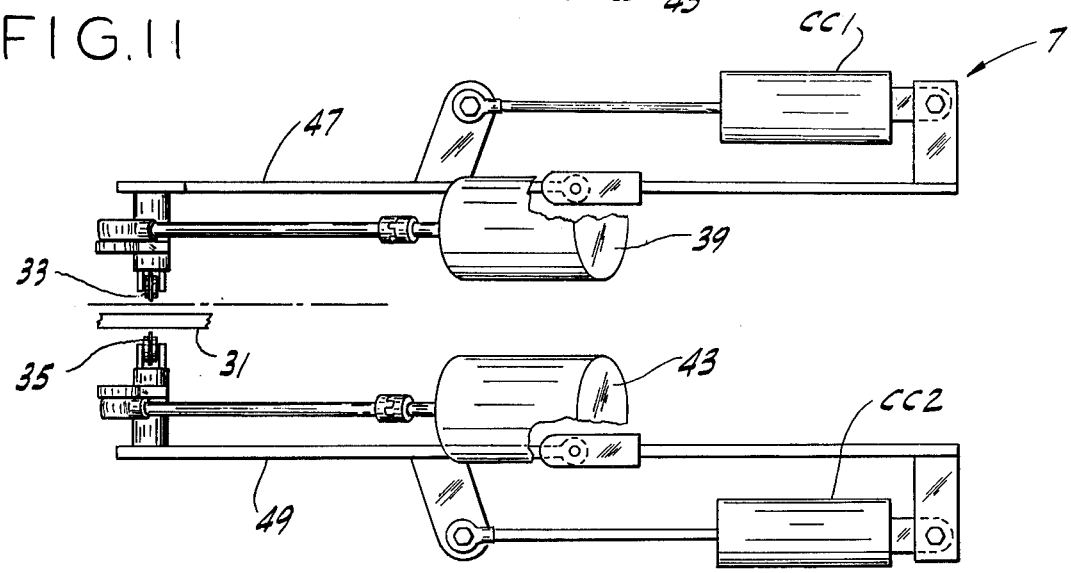
FIG. 11 is a view in elevation on line 11—11 of FIG. 10, with parts broken away.

Referring to the drawings, first more particularly to FIGS. 1–3, there is generally indicated at 1 apparatus of this invention for joining together two pieces or plies A and B of material, such as textile fabric. The apparatus generally comprises means indicated at 3 for seaming the two plies together along an edge thereof, more particularly a sewing machine, having means indicated generally at 5 in FIG. 9 for feeding the two plies therethrough in a predetermined direction, which may be referred to as the direction of feed. The apparatus further comprises contour guide means indicated generally at 7 for shifting the plies as they are fed forward by the feeding means 5 to effect contour seaming of the plies i.e., edge seaming of the plies with the edges along which they are seamed generally in register and with the seam generally uniformly spaced from the edges (e.g., one-quarter inch from the edges). This contour guide means 7 may generally correspond to that shown in my U.S. Pat. 3,636,898 issued Jan. 25, 1972.

In accordance with this invention, there is provided means indicated generally at 9 for controlling the feed of the plies A and B to the contour guide means 7 properly to present the plies to the contour guide means to avoid wrinkling of the pieces or other problems (such as may otherwise result from the inertia of the mass of the plies), and also to provide for seam and equalization as will appear. This feed control means 9 comprises a clamp 11, which may be referred to as the feed control clamp, for clamping the plies A and B as they are fed forward and shifting them generally to maintain their edges to be seamed generally aligned with the contour guide means 7, as will appear. The clamp 11 is biased in the direction away from the sewing machine 3 to maintain the plies under tension as they are fed forward, as will also appear. Means indicated generally at 13 is provided mounting the clamp 11 for movement with the plies as they are fed forward and also for side-to-side movement relative to the direction of feed, and means indicated generally at 15 is provided for shifting the clamp 11 from side to side as it moves forward generally to maintain the edges of the plies aligned with the contour guide means. This shift means 15 is controlled by pneumatic sensor means 17 (see FIGS. 4, 9, 12 and 14) which senses the position of the edge of the plies A and B as they enter the contour guide means and signals the shift means to shift the work clamp 11 in accordance with variation in the position of the edge relative to the sensors as the pieces travel forward through the sensor.

The apparatus 1 comprises a table 19 having a top 21 (which may be made of sheet metal plate). The top 21 has a flat horizontal forward portion **21*a* and a curved rearward portion 21*b*, the latter being curved on an arc centered in an axis indicated at 23 which extends transversely with respect to the table below the plane of the horizontal top portion 21*a* of the table and in a vertical plane which generally intersects the rearward end of portion 21*a*. The latter extends forward from the upper forward end of the curved portion 21*b* tangentially with respect to the curved portion. The term "forward" is employed in the sense of downstream with respect to the direction of feed of the plies A and B, and the term "rearward" is employed in the sense of upstream. The sewing machine 3 is mounted on the table in a cutout 24 at the forward right-hand corner of the horizontal forward portion 21*a* of the table top, with the top of the bed of the machine flush with 21*a*. The "right" and "left" sides of the table top 21 are as viewed in forward (downstream) direction. The sewing machine is a conventional machine having the usual feed dogs such as indicated at 25 in FIG. 9 for feeding work over the bed of the machine and under its pressure foot 27 for being stitched by the needle N of the machine. It is arranged extending transversely with respect to the table top 21 and with its throat opening toward the left side of the table. The presser foot is adapted to be raised and lowered in conventional manner by an air cylinder CF (see FIG. 15**).

The contour guide means 7 for guiding the two pieces A and B to effect contour seaming of the pieces comprises a separator plate 31 (see FIGS. 4, 9 and 12) and upper and lower guide wheels 33 and 35 corresponding generally to the separator plate 29 and upper and lower guide wheels 61 and 151 of my aforesaid U.S. Pat. No. 3,636,898. This plate is located in a horizontal plane slightly above the level of the horizontal forward portion **21*a* of the table top 21 at a rearward stepped portion 24*a* of the cutout 24 at the right-hand forward corner of portion 21*a*. The upper ply A of material feeds over the plate 31 between the upper wheel 33 and the plate, and the lower ply B of material feeds under the plate between the lower wheel 35 and the plate. Each wheel is mounted for rotation on a generally horizontal axis and for swinging movement about a generally vertical axis offset from the wheel axis on the rearward (upstream) side of the wheel axis as in my aforesaid U.S. Pat. No. 3,636,898. The upper wheel 33 is swingable about its vertical swing axis by means of an air cylinder 39 under control of a pneumatic edge sensor 41 for the upper ply A, and te lower wheel 35 is swingable about its vertical swing axis by means of an air cylinder 43 under control of a pneumatic edge sensor 45 for the lower ply B. Cylinders 39 and 43 correspond to cylinders 95 and 165 shown in said U.S. Pat. No. 3,636,898, and sensors 41 and 45 correspond to sensors 209 etc. and 219** etc. shown in said patent.

The upper wheel 33 is mounted as indicated at 47 to swing down from a raised retracted position to grip the upper ply A and the lower wheel 35 is similarly mounted as indicated at 49 to swing up from a lowered position to grip the lower ply B. An air cylinder CC1 is provided for moving the wheel 33 up and down, and an air cylinder CC2 is provided for moving the wheel 35 up and down. The function of these cylinders corresponds generally to the funtion of cylinder 193 of U.S. Pat. No. 3,636,898. The separator plate 31 is pivoted as indicated at 51 for swinging movement from the opertive position between the wheels in which it is illustrated in solid lines in FIG. 9 to the retracted position off to the right in which it is illustrated in phantom in FIG. 9, and is adapted to be swung between these positions by an air cylinder CG. Sensors 41 and 45 are carried by the separator plate 31 adjacent its forward (downstream) end. The pneumatic sensor means 17 for controlling the shift means for the work clamp 11 comprises a pneumatic edge sensor for both plies A and B carried by the separator plate 31 adjacent its rearward (upstream) end.

In the operation of the contour guide means 7, as the upper ply A is fed forward over the separator plate 31 by the feed means 25 of the sewing machine 3, the upper wheel 33 is held down in engagement with the upper ply against the separator plate, and as the lower ply B is fed forward under the separator plate by the feed means 25, the lower wheel 35 is held up in engagement with the lower ply against the bottom of the separator plate. The upper pneumatic edge sensor 41 continuously senses the position of the edge of the upper ply A of material relative to the needle N of the sewing machine as the plies are fed through the sewing machine and acts via the cylinder 39 to swing the upper wheel 33 to shift the upper ply A to maintain its edge in predetermined spaced relation (e.g., one-quarter inch) from the needle.

Similarly, the lower pneumatic edge sensor 45 continuously senses the position of the edge of the lower ply B of material relative to the needle N as the plies are fed through the sewing machine and acts via the cylinder 43 to swing the lower wheel 35 to shift the lower ply to maintain its edge in predetermined spaced relation (e.g., one-quarter inch) from the needle.

At 61 is generally indicated loading means which is adapted, while one assembly of plies A and B is being seamed (i.e., while this assembly is being fed through the sewing machine 3 and stitched) to receive the next assembly of plies A and B to be seamed and, upon completion of seaming the first assembly, to enter the next assembly in the sewing machine and in the control clamp 11. The clamp 11 is adapted to clamp the plies A and B at their trailing ends and the loading means 61 is movable to enter the trailing ends of the plies in the control clamp while the latter is at rest in the starting position in which it is illustrated in FIG. 1.

The mounting means 13 for clamp 11 comprises an arm 63 pivoted for swinging movement on the axis 23 at the center of curvature of the curved section 21*b* of table top 21. This arm extends up from its pivot at 23 on the right-hand side of the table [as viewed in forward (downstream) direction] slightly beyond the right-hand edge of the table top 21. A bar 65 extends at right angles to the arm over the table top 21 from the right side of the table top toward the left. This bar 65 is a fixed bar of a four-bar linkage 67 (see FIGS. 1–3 and 5) carrying the clamp 11. This linkage comprises left and right side bars 69 and 71 pin-connected as indicated at 73 at their rearward ends to the bar 65 and extending forward therefrom, and a forward bar 75 pin-connected at its ends as indicated at 77 to the forward ends of the side bars. The clamp 11 comprises a lower jaw 79 fixed to bar 75 and extending forward therefrom and an upper jaw 81 pivoted at 83 on the bar 75 and operable by an air cylinder CI pivoted at 87 on an extension 89 of the lower jaw 79. Means indicated generally at 91 is provided for swinging the right side bar 71 from side to side for shifting the bar 75 and the clamp jaws 79 and 81 from side to side relative to the table. Pins 77 are spaced a distance less than pins 73, causing the bar 75 to angle as it shifts from side to side in such manner as to maintain jaws 79 and 81 directed generally toward the needle N of the sewing machine 3.

The arm 63 has a weight 93 (see FIGS. 1–3 and 8) at its lower end below the pivot 23 and so located relative to the pivot 23 as to bias the arm to tend to swing downward (counterclockwise as viewed in FIGS. 1–3 and 8 thereby tending to swing the clamp 11 rearward away from the sewing machine for tensioning the plies being sewn, as will appear. It is adapted to be held against swinging downward in its aforesaid starting position of FIGS. 1 and 8 by means indicated generally at 95, and shown as comprising a latch 97 and an air cylinder CJ1 for operating the latch. The latter, when in its operative position, is engageable by the lower end of the arm (see FIG. 8) to hold the arm from swinging downward past its starting position under the bias of the weight 93. When the latch is retracted (pulled downward) by the cylinder, the arm is freed to swing down (i.e., to swing counterclockwise as viewed in FIG. 8) from its starting position.

The means 91 for swinging the bar 71 from side to side to shift the control clamp jaws 79 and 81 from side to side comprises an air cylinder 101 carried by a bracket 103 on the arm 63 adjacent the lower end of the arm, and a linkage 105 interconnecting the piston rod 107 of cylinder 101 and the bar 71. This linkage comprises a bell crank 109 pivoted at 111 on the arm 63 adjacent its upper end, a link 113 interconnecting piston rod 107 and one arm of the bell crank and a link 115 interconnecting the other arm of the bell crank and bar 71. The arrangement is such that when the piston rod 107 of the cylinder 101 is retracted, the bar 71 is swung to the right, and when the piston rod is extended, bar 71 is swung to the left.

The loading means 61 (see FIG. 1–3 and 6) comprises a first loading clamp 117 for clamping the plies A and B at their leading ends and a second loading clamp 119 (see FIGS. 1–3 and 7) for clamping the plies away from their leading ends, and more particularly for clamping the plies adjacent their trailing ends. The first loading clamp 117 is movable laterally from a retracted ply-receiving position at the left of the sewing machine 3 (in which it is shown in FIG. 1) to enter the plies in the sewing machine and in the contour guide means 7, as will appear. The second loading clamp 119 is movable laterally and rearwardly from a retracted ply-receiving position rearward of the first loading clamp (in which it is shown in FIG. 1) to enter the trailing ends of the plies A and B in the clamp 11, as will appear.

Figure 12:
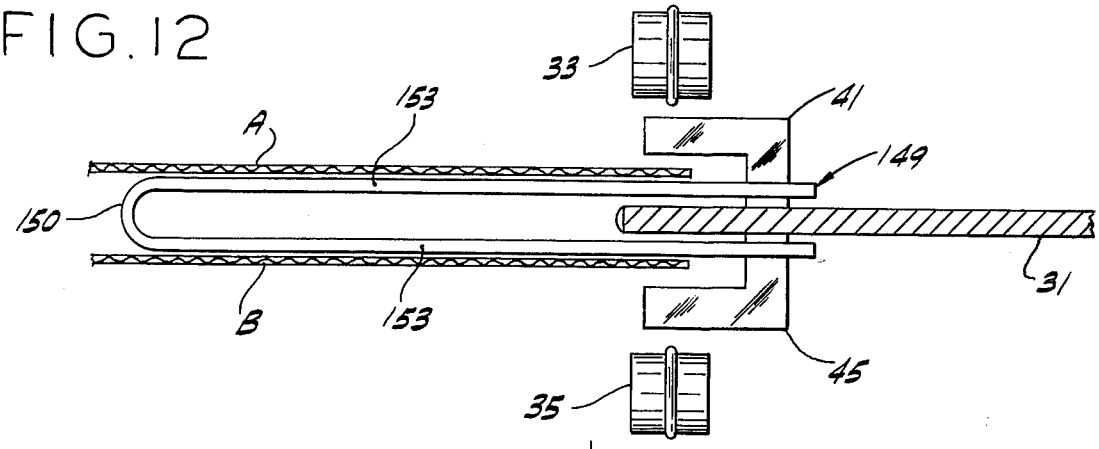
FIG. 12 is a vertical transverse section showing parts of the contour guide means and also showing a fork of the loading means of the apparatus.

The first loading clamp 117 (which may also be referred to as the forward loading clamp) is carried by a carriage 121 constituted by a tubular slide member slidable on a guide rod 123 extending transversely over the horizontal forward portion 21*a* of the table top 21 adjacent its forward end (and somewhat forward of the sewing machine 3). Rod 123 is carried by a frame structure such as indicated at 125 supported by the table. Clamp 117 comprises a lower jaw 127 extending rearward from the carriage 121 and fixed to the carriage, and an upper jaw 129 pivoted at 131 on the lower jaw for swinging movement between an open and a closed position. The lower jaw 127 has a forward extension 133 carrying a head 135 in slidable engagement with a bar 137 for preventing rotation of the carriage 121 on the rod 123 and holding the lower jaw horizontal. An air cylinder CB carried by the frame 125 has its piston rod 139 pinned at 141 to the lower jaw extension 133 to slide the carriage lengthwise along the rod 123 and thus move the clamp 117 laterally over the table top 21 adjacent its forward end. An air cylinder CA pinned at 143 on a post 145 extending up from the lower jaw 127 has its piston rod connected at 147 to the upper jaw 129 for swinging the latter open and closed. A fork 149 for separating the two plies A and B of material is provided at the rearward end of the lower jaw 127. the fork comprises a metal strip bent at 150 to narrow U-shape and mounted in horizontal position on a rod 151 extending rearward from the lower jaw so as to have an upper tine 153 and a lower tine 155, the rod 151 extending between these tines. The fork extends transversely of the lower jaw 127 at its rearward end with the open end of the fork directed toward the right. The fork 149 is aligned transversely of the apparatus with the separator plate 31 and is located slightly above the table top 21 in position to straddle the separator plate (as shown in FIG. 12) when the clamp 117 is moved to the right from its retracted position of FIG. 1 to enter the leading ends of the plies A and B in the sewing machine (on the bed of the machine under its presser foot). Thus, with ply A on top of the fork and ply B on the bottom of the fork, ply A is brought into position on top of the separator plate 31 and below the upper guide wheel 33 of the contour guide means, and ply B is brought into position on the bottom of the separator plate and above the lower guide wheel 35 of the contour guide means, wheel 33 being raised and wheel 35 being lowered by their respective retraction cylinders CC1 and CC2 for such positioning of the plies.

The second or rearward loading clamp 119 is carried by a carriage 161 (see FIGS. 1–3 and 7) movable transversely relative to the table top 21 on the upper crossbar 163 of an inverted U-shaped frame 165 pivoted for swinging movement on the axis 23. The side arms of this frame are each designated 167; they extend up from the axis 23 on the right and left sides of the table top 21. Crossbar 163 extends between the upper ends of the arms 167 above the tabel top. An air cylinder CE (see FIG. 8 ) is provided for swinging the frame 165 to move the crossbar 163 forward and rearward over the table top between the forward position in which it is illustrated in FIG. 1 and the rearward position in which it is illustrated in FIG. 2. The carriage 161 comprises a pair of tubular slide members 169 slidable on a pair of guide rods 171 extending transversely of the apparatus and lengthwise of the crossbar 163 below the latter between a pair of supports 173 extending down from the crossbar. An air cylinder CH is provided for sliding the carriage 161 on the rods 171 between the retracted position in which it is illustrated in FIG. 1 and the advanced position in which it is illustrated in FIG. 2. The clamp 119 comprises a lower jaw 175 extending forward from the carriage 161 and a pair of clamping pads 177 on the lower ends of the piston rods 179 of air cylinders CD1 and CD2 carried by a bracket 181 extending forward from the carriage 161 above the lower jaw 175.

Figure 8:
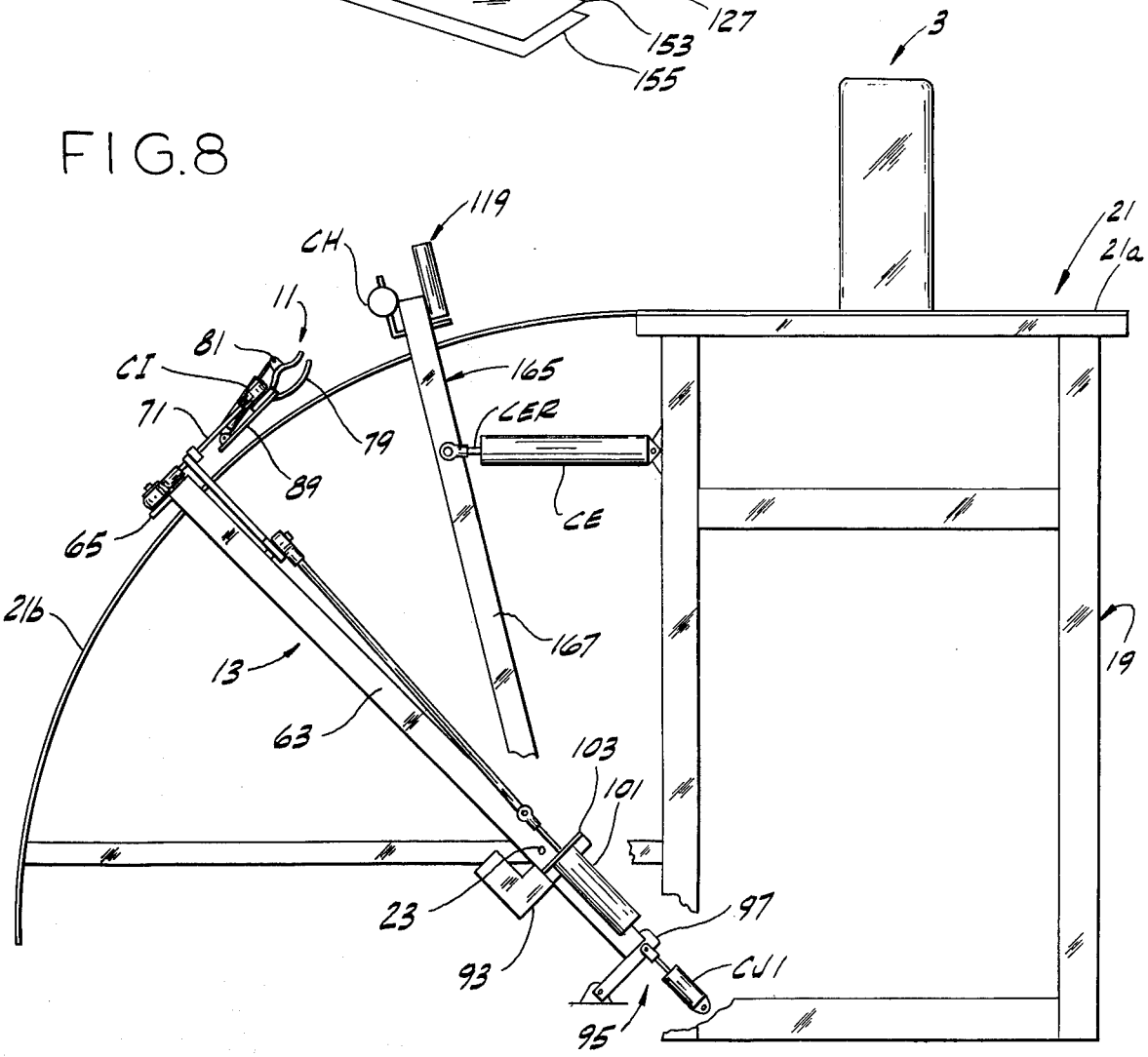
FIG. 8 is a side elevation as viewed from the right side of FIG. 1, with parts broken away and parts omitted.
Figure 7:
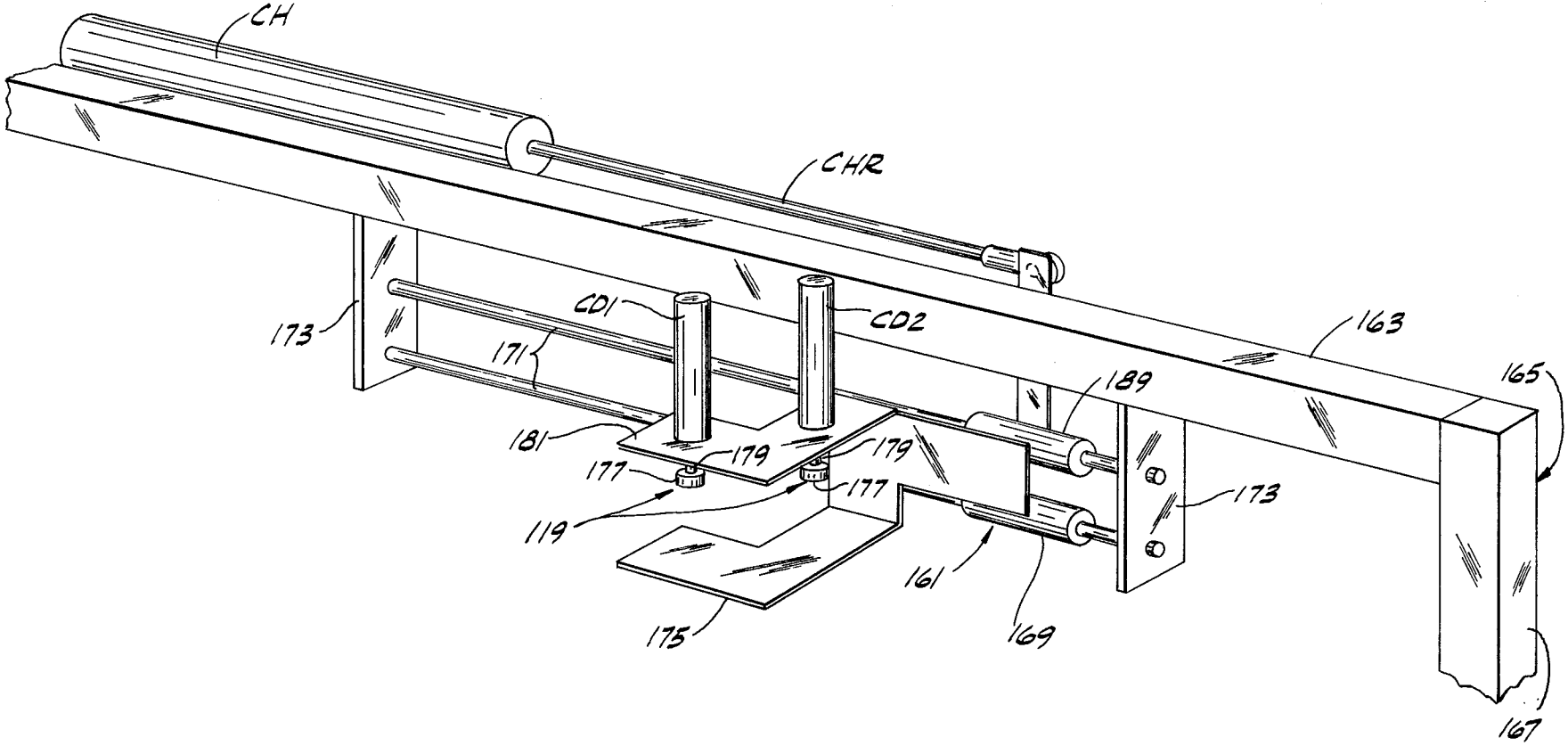
FIG. 7 is a semidiagrammatic perspective, viewed in the opposite direction from FIG. 1, showing a second loading clamp of the apparatus and its operating mechanism.

With the piston rod CER of cylinder CE retracted, the frame 165 occupies its forward or starting position of FIGS. 1 and 8. With the piston rod CHR of cylinder CH extended, the carriage 161 occupies its retracted starting position of FIGS. 1 and 7, toward the left side of the table top. With the frame 165 in its starting position and the carriage 161 in its starting position, the rearward loading clamp 119 occupies a starting position generally in line with and rearward of the forward loading clamp 117 (in its retracted position toward the left side of the table top) to the left and forward of the control clamp 11 in its starting position. On extension of piston rod CER of cylinder CE and retraction of piston rod CHR of cylinder CH, the frame 165 swings rearward to carry clamp 119 rearward and the clamp 119 moves to the right as it moves rearward, bringing it over laterally and downwardly to the clamp 11 directly in front of the latter.

Figure 15:
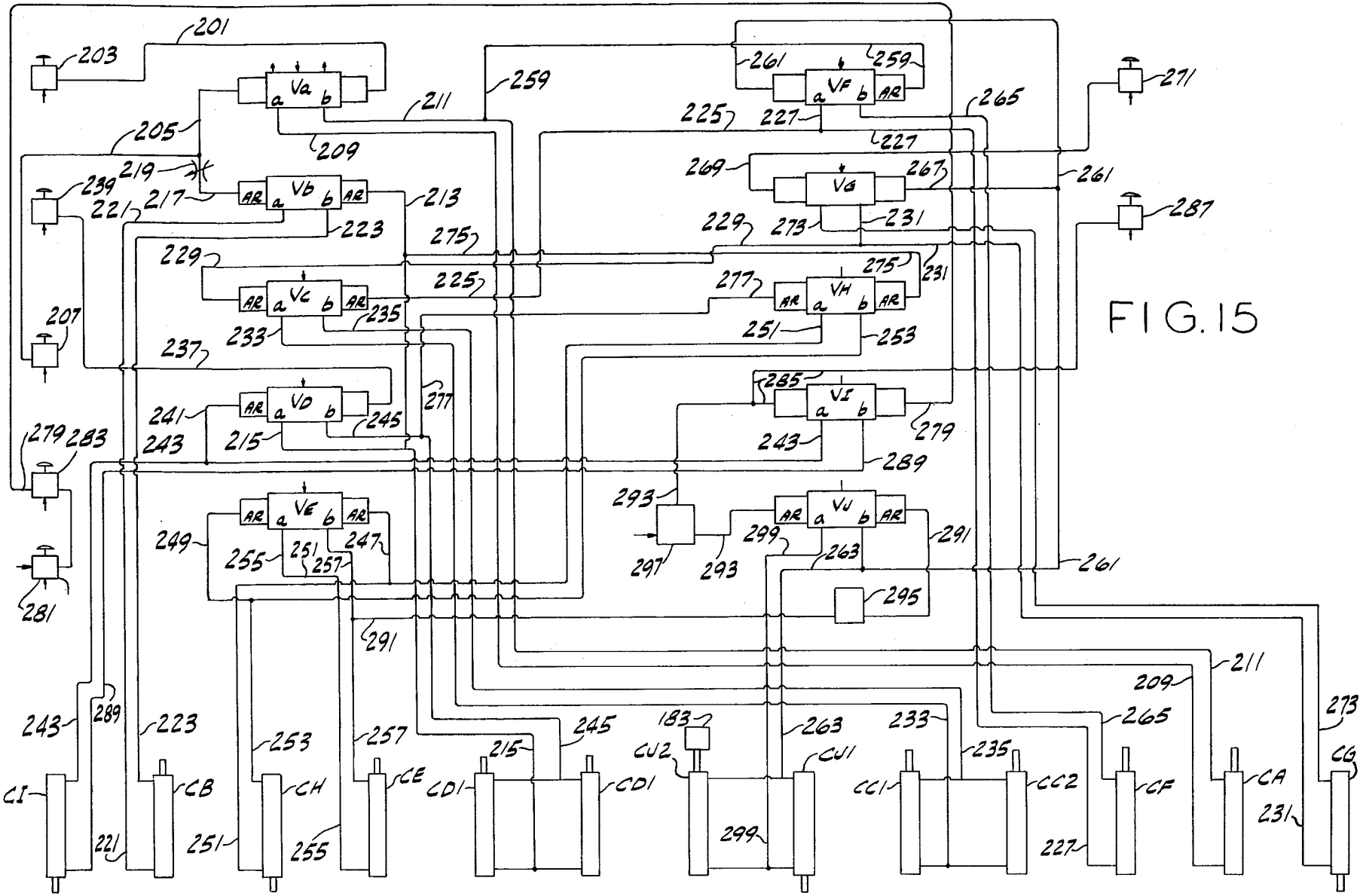
FIG. 15 is a diagram of certain pneumatic circuitry associated with the loading means of the apparatus.

Referring to FIG. 15, the apparatus is shown as having valves VA, VB, VC, VD, VE, VF, VG, VH, VI and VJ for controlling the cylinders CA, CB, CC1 and CC2, CD1 and CD2, CE, CF, CG, CH, CI and CJ1, respectively. Each of these valves is of the type having an inlet for air under pressure (indicated by an arrow) and a spool (not shown) shiftable by an air-operated actuator at the right to direct air under pressure from the inlet to a port *a* and to connect a port *b* to atmosphere, and shiftable by an air-operated actuator at the left to direct air under pressure from the inlet to *b* and to connect *a* to atmosphere. Actuators designated AR are of a type which reset automatically after they have been actuated by air pressure. Actuators designated AS are of a type which delay actuation until air pressure has been built up to a predetermined value, and then snap. All the other actuators are of the type which operate without delay and without reset on actuation by air pressure. A cylinder CJ2 for operating a clutch 183 for the sewing machine 3 is interconnected with cylinder CJ1 for conjoint operation with cylinder CJ1 under control of valve VJ. All the cylinders CA — CJ2 are double-acting air cylinders.

Valve VA controls the cylinder CA for actuating the upper jaw 129 of the first or forward loading clamp 117, and is itself controlled by a line 201 including a valve 203 connected between a compressed air source and the right-hand actuator of valve VA. Valve 203 is illustrated as a manually operable push-button valve which when actuated supplies air to the right-hand actuator of valve VA and when deactuated vents said right-hand actuator. VAlve VA is further controlled by a line 205 including a valve 207 connected between the compressed air source and the left-hand actuator of valve VA. Valve 207 is illustrated as a push-button valve which when actuated supplies air to the left-hand actuator of valve VA and when deactuated vents said left-hand actuator. It is actuated by the forward loading clamp carriage 121 as the latter reaches the end of its stroke toward the right, i.e., when the forward loading clamp 117 enters the leading ends of the plies A and B in the sewing machine and brings ply A into position on top of the separator plate 31 and ply B into position on the bottom of the separator plate. A line 209 interconnects port *a* of valve VA and the rear end of cylinder CA and a line 211 interconnects port *b* of valve VA and the forward end of cylinder CA.

Valve VB controls the cylinder CB for driving the forward loading clamp carriage 121, and is itself controlled by a line 213 connected to its right-hand actuator, this line 213 being connected to a line 215 which interconnects port *a* of valve VD and the rear ends of cylinders CD1 and CD2. Valve VB is further controlled by a line 217 interconnected between line 205 and the left-hand actuator of valve VB, whereby the left-hand actuator of valve VB is under control of the aforesaid valve 207. Line 217 includes a flow control 219 for delayed action of the left-hand actuator of valve VB on actuation of valve 207. A line 221 interconnects port *a* of valve VB and the rear end of cylinder CB, and a line 223 interconnects port *b* of valve VB and the forward end of cylinder CB.

Valve VC controls the cylinders CC1 and CC2 for raising and lowering the top and bottom guide wheels 33 and 35, and is itself controlled by a line 225 connected to its right-hand actuator, this line 225 being connected to a line 227 which interconnects port *a* of valve VF and the rear end of cylinder CF. Valve VC is further controlled by a line 229 connected to its left-hand actuator and to a line 231 which interconnects port *b* of valve VG and the rearward end of cylinder CG. A line 233 interconnects port *a* of valve VC and the rear ends of cylinders CC1 and CC2 and a line 235 interconnects port *b* of valve VC and the forward ends of cylinders CC1 and CC2.

Valve VD controls the rearward loading clamp cylinders CD1 and CD2, and is itself controlled by a line 237 connected to its right-hand actuator, this line 237 including a valve 239 and being interconnected between the compressed air source and the right-hand actuator of valve VD as shown in FIG. 15. Valve 239 is illustrated as a push-button valve which when actuated supplies air to the right-hand actuator of valve VD and when deactuated vents said actuator. It may be manually actuated, or actuated by means which senses the proper positioning of work in the rearward loading clamp 119. Valve VD is further controlled by a line 241 connected to its left-hand actuator and to a line 243 which interconnects port *a* of valve VI and the rear end of cylinder CI. A line 245 interconnects port *b* of valve VD and the forward ends of cylinders CD1 and CD2.

Valve VE controls cylinder CE for swinging the frame 165 which carries the rearward loading clamp 119, and is itself controlled by a line 247 connected to its right-hand actuator and a line 249 connected to its left-hand actuator. Line 247 is connected to a line 251 which interconnects port *a* of valve VH and the forward end of cylinder CH, and line 249 is connected to a line 253 which interconnects port *b* of valve VH and the rear end of cylinder CH. Lines 255 and 257 interconnect ports *a* and *b* of valve VE with the rear and forward ends, respectively, of cylinder CE.

Valve VF controls cylinder CF for the presser foot of the sewing machine, and is itself controlled by a line 259 interconnecting its right-hand actuator and line 211, and by a line 261 connected to a line 263 which interconnects port *b* of valve VJ and the rearward end of cylinder CJ1 and the forward end of cylinder CJ2. A line 265 interconnects port *b* of valve VF and the forward end of cylinder CF.

Valve VG controls cylinder CG for the separator plate 31, and is itself controlled by a line 267 connected to its right-hand actuator and line 261, and by a line 269 including a valve 271, this line 269 being interconnected between the compressed air source and the left-hand actuator of valve VG. Valve 271 is illustrated as a push-button valve which when actuated supplies air to the left-hand actuator of valve VG and when deactuated vents said actuator. Valve 271 is actuated by the arm 63 which carries the work clamp 11 when the work clamp 11, in being pulled up and forward by the work, approaches the contour guide means 7. A line 273 interconnects port *a* of valve VG and the rear end of cylinder CG.

Valve VH controls cylinder CH for driving the rearward loading clamp carriage 169, and is itself controlled by a line 275 connected to its right-hand actuator and line 213, and by a line 277 connected to its left-hand actuator and line 245.

Valve VI controls cylinder CI for the work clamp 11, and is itself controlled by a line 279 including two valves 281 and 283 in series, this line 279 being interconnected between the compressed air source and the right-hand actuator of valve VI. Each of valves 281 and 283 is illustrated as a push-button valve which when actuated is adapted to deliver air from the source and when deactuated to vent the line downstream from the valve. Valve 281 is adapted for actuation by the frame 165 carrying the rearward loading clamp 119 when the latter reaches the upper end of its upward stroke (i.e., when the piston rod of cylinder CE reaches its retracted position). Valve 283 is adapted for actuation by carriage 169 carrying the rearward loading clamp 119 when the latter reaches the end of its traverse to the right (i.e., when the piston rod of cylinder CH reaches its extended position). When both valves 281 and 283 are actuated, air is supplied to the right-hand actuator of valve VI, and when valve 283 is deactuated, this actuator is vented. Valve VI is further controlled by a line 285 including a valve 287, this line 285 being interconnected between the compressed air source and the left-hand actuator of valve VI. Valve 287 is illustrated as a push-button valve which when actuated supplies air to the left-hand actuator of valve VI and when deactuated vents said actuator. Valve 287 is adapted for actuation by the arm 63 which carries the work clamp 11 when the work clamp, in being pulled forward by the work, passes by the contour guide means 7 and approaches the presser foot 27 of the sewing machine 3. A line 289 interconnects port *b* of valve VI and the forward end of cylinder CI.

Valve VJ controls the cylinders CJ1 and CJ2, and is itself controlled by a line 291 interconnected between its right-hand actuator and line 257, and a line 293 interconnected between its left-hand actuator and line 285. Lines 291 and 293 include suitable conventional pneumatic delays 295 and 297, respectively. A line 299 interconnects port *a* of valve VJ with the forward end of cylinder CJ1 and the rearward end of cylinder CJ2.

Figure 13:
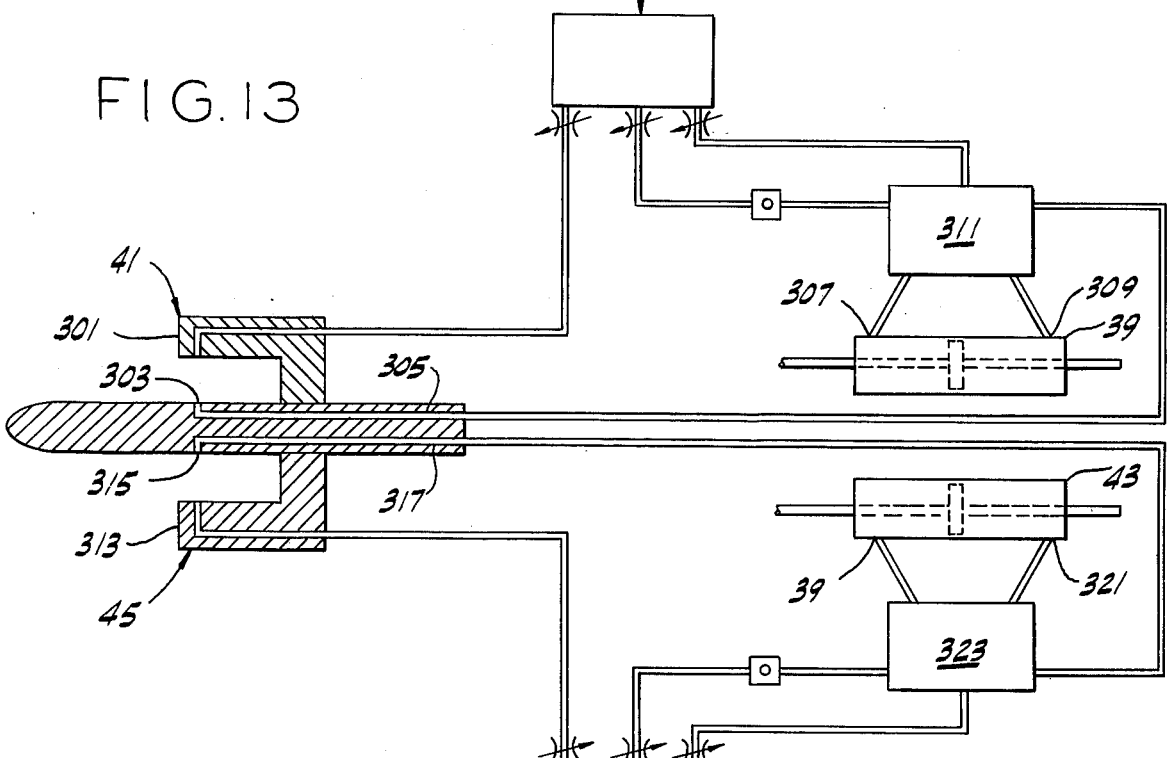
FIG. 13 is a diagram of certain pneumatic circuitry associated with the contour guide means of the apparatus.

Referring to FIG. 13, the pneumatic edge sensor 41 for the upper ply A is shown to comprise a nozzle 301 through which a stream of air is directed downward toward the inlet 303 of an upper air passage 305 in the separator plate 31. Cylinder 39 of the contour guide means 7 has ports 307 and 309. The supply of air to these ports is controlled by an air porportioning device 311, corresponding to the device designated 247 in U.S. Pat. NO. 3,636,898, which is itself controlled by the sensor 41, as in said patent. Similarly, the pneumatic edge sensor 45 for the lower ply is shown to comprise a nozzle 313 through which a stream of air is directed upwardly toward the inlet 315 of a lower air passage 317 in the separator plate 31. Cylinder 43 of the contour guide means has ports 319 and 321. The supply of air to these ports is controlled by an air proportioning device 323, the same as 311. Reference may be made to U.S. Pat. No. 3,636,898 for a complete description of the operation of the sensors and the air proportioning devices to operate cylinders 39 and 43 to swing the wheels 33 and 35 to effect contour seaming of the plies A and B.

Figure 14:
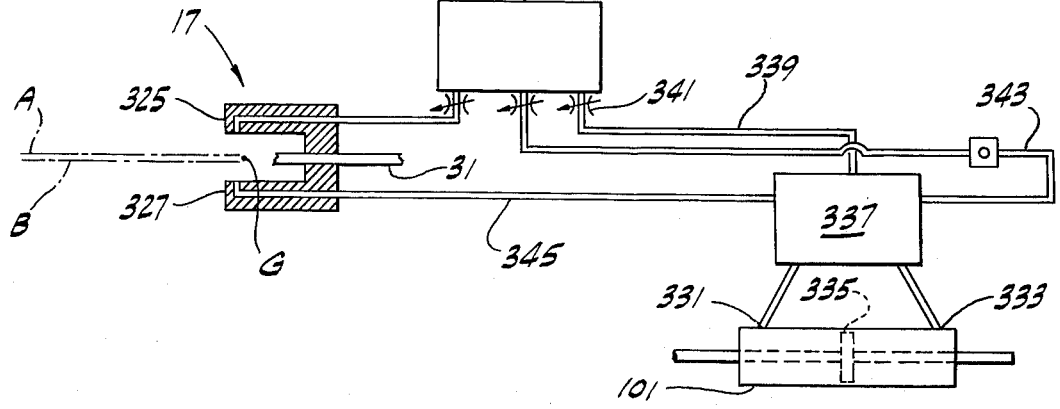
FIG. 14 is a diagram of certain pneumatic circuitry associated with the control clamp of the apparatus.

Referring to FIG. 14, the pneumatic edge sensor 17 carried by the separator plate 31 adjacent its rearward end comprises an air nozzle 325 positioned to direct a continuous stream of air downward toward an air inlet 327. The nozzle is mounted on top of the separator plate and the inlet is mounted on the bottom of the plate projecting outwardly beyond the edge of the plate at a cutout 329 in the plate, the arrangement being such as to provide a gap G between the lower end of the nozzle and the upper end of the inlet for passage of the plies A and B between the lower end of the nozzle and the upper end of the inlet. Cylinder 101 has ports 331 and 333 for admission of air to and venting of air from opposite sides of its piston 335. Supply of air to these ports is under control of an air porportioning device 337 of the same type as indicated at 247 and 249 in U.S. Pat. No. 3,636,898. This device is supplied with air from the compressed air source via a line 339 including a flow regulator 341. At 343 is indicated a control pressure line connected to the proportioning device, and at 345 is indicated a line connecting the inlet 327 and the air proportioning device.

Air pressure in line 345 varies in accordance with the opening or closing of the inlet 327 by the edge of ply A or ply B as they travel forward toward the edge 347 of the separator plate 31 at the cutout 329. Ply A then travels over and ply B then travels under the plate toward the guidewheels 33 and 35. The normal position of the edge of either ply as it travels through the gap G may be considered as the position in which the edge portion of the ply halfway closes off the inlet 327.

Under these circumstances, the air pressures in cylinder 101 on opposite sides of the piston 335 are balanced by the air porportioning device 337. If the edge portion should in effect shift to the right (as viewed in downstream direction), it will close off the inlet and decrease the admission of air to the inlet, with the result that the pressure in line 345 drops. The air proportioning device 337 thereupon functions to increase the pressure in port 333 and decrease the pressure in port 331 with the result that the piston rod 107 is extended to shift the clamp 11 to the left to bring the edge of the work back to the normal position (bisecting the inlet). If the edge portion should in effect shift to the left, it will open up the inlet further and increase the admission of air to the inlet with the result that the pressure in line 345 increases. The air proportioning device 337 thereupon functions to increase the pressure in port 331 and decrease the pressure in port 333 with the result that the piston rod 107 is retracted to shift the clamp 11 to the right to bring the edge of the work back to the normal position.

At the start of a cycle of operation, the sewing machine 3 is stopped and its presser foot 27 is raised. The separator plate 31 of the contour guide means 7 is in its operative position. The upper wheel 33 of the contour guide means is raised and the lower wheel 35 is lowered. The first or forward loading clamp 117 is in its retracted ply-receiving position at the left of the table top 21 and is open, ready to receive work, as shown in FIG. 1. The second or rearward loading clamp 119 is in its forward position, the piston rod of cylinder CE being retracted, and in its retracted ply-receiving position at the left of the table top 21 (see particularly FIG. 1). Clamp 119 is also open, ready to receive work. The control clamp 11 is in its starting position as determined by arm 63 being latched in starting position by the latch 97.

The operator takes the two plies A and B which are to be sewn together, and with ply A on top of ply B, places the leading ends of the two plies in the forward loading clamp 117 (which is open). In doing so, she places ply A on top of the fork 149 (i.e., on top of the upper tine 153 of the fork) and ply B on the bottom of the fork (i.e., on the bottom of the lower tine 155). She also makes certain that the leading ends of the plies are matched, as she places them on the lower jaw 127 of the clamp 117, and under its upper jaw 129 (which is open). She then actuates the valve 203 (i.e., pushes its button). On actuation of valve 203 (which could be effected automatically by sensors in jaw 127 sensing the entry of the leading ends of the work in proper position in clamp 117 instead of manually), valve VA is actuated to deliver air under pressure via line 209 to the rearward end of cylinder CA and to vent air from the forward end of cylinder CA via line 211. The piston rod of cylinder CA is thereby extended to close the jaw 129 of clamp 117 and clamp the leading ends of the plies between these jaws.

Having effected the clamping of the leading ends of the plies A and B by the forward loading clamp, the operator places the trailing ends of the plies in the rearward loading clamp 119, making certain that they are matched. This placement is effected by matching the trailing ends of the plies and placing them on the lower jaw 175 of clamp 119, under the clamping pads 177. The operator then actuates valve 239 (i.e., she pushes its button). On actuation of valve 239 (which could be effected automatically by sensors in jaw 175 sensing the entry of the trailing ends of the work in proper position in clamp 119 instead of manually), valve VD is actuated to deliver air under pressure via line 215 to the rearward ends of the clamp cylinders CD1 and CD2 (which are their upper ends as viewed in FIG. 7 and their lower ends as viewed in FIG. 15) and to vent the piston rod ends of these cylinders via line 245. The piston rods 179 of cylinders CD1 and CD2 are thereby extended so that the pads 177 on the lower ends of the piston rods clamp the trailing ends of the plies down against the lower jaw 175.

Air under pressure is delivered from line 215 via line 213 to the right-hand actuator of valve VB,thereby actuating valve VB to deliver air pressure via line 221 to the rearward end of cylinder CB and to vent the forward (rod) end of cylinder CB via line 223. The piston rod 139 of cylinder CB is thereupon extended to slide the carriage 121 and clamp 117 from their retracted ply-receiving position at the left of the table top toward the right. The clamp 117, carrying the leading ends of plies A and B with it, with ply A on top of the fork and ply B under the fork, is traversed to the right, and brings the leading ends of the plies over the bed of the sewing machine 3 under the pressure foot 27 of the sewing machine. The fork 149, travelling with the clamp 117, straddles the separator plate 31, i.e., its upper tine 153 comes over and its lower tine comes under the separator plate. This brings the upper ply A on top of the separator plate under the upper guide wheel 33 and the lower ply on the bottom of the separator plate above the lower guide wheel 35.

Air under pressure is also delivered from line 213 via line 275 to the right-hand actuator of valve VH, thereby actuating valve VH to deliver air pressure via line 251 to the forward end of cylinder CH and to vent the rearward end of cylinder CH via line 253. The piston rod of cylinder CH is thereupon retracted to slide the carriage 161 and the rearward loading clamp 119 (now closed) from the retracted ply-receiving position at the left of the table top toward the right. The clamp 119, carrying the trailing ends of plies A and B with it, is thus traversed to the right, maintaining clamp 119 generally in line with clamp 117 as they both move over to the right.

Air under pressure is delivered from line 251 via line 247 to the right-hand actuator of valve VE, thereby actuating valve VE to deliver air pressure via line 255 to the rearward end of cylinder CE and to vent the forward end of cylinder CE via line 257. The piston rod CER of cylinder CE is thereupon extended to swing the frame 165 down, thereby carrying the rearward work clamp 119 rearward as it traverses from left to right. The trailing ends of the plies A and B, clamped in clamp 119, are thus brought rearward and to the right and entered in the work clamp 11 (which is open) as shown in FIGS. 1 and 2, clamp 11 being so positioned as to receive said trailing ends.

As the carriage 121 and clamp 117 reach the end of their traverse to the right (with the accompanying entry of the leading ends of plies A and B in the sewing machine 3 and in the contour guide means 7) valve 207 is actuated. This results in delivery of air via line 205 to the left-hand actuator of valve VA, thereby actuating valve VA to deliver air via line 211 to the forward end of cylinder CA and to vent air from the rearward end of cylinder CA. The piston rod of cylinder CA is thereupon retracted to open clamp 117 by swinging up its upper jaw 129 for releasing the leading ends of the plies.

Air under pressure is delivered from line 211 via line 259 to the right-hand actuator of valve VF, thereby actuating valve VF to deliver air under pressure via line 227 to the rearward end of cylinder CF and to vent the forward end of cylinder CF via line 265. The piston rod of cylinder CF is thereupon extended to lower the presser foot 27 to clamp the leading ends of the plies down against the bed of the sewing machine in preparation for the start of sewing.

Air under pressure is delivered from line 227 via line 225 to the right-hand actuator of valve VC, thereby actuating valve VC to deliver air under pressure via line 233 to the rearward ends of cylinders CC1 and CC2 and to vent the forward ends of these cylinders via line 235. The piston rods of cylinders CC1 and CC2 are thereby extended to lower the upper guide wheel 33 into engagement with the upper ply A on top of the separator plate 31 and to raise the lower guide wheel 35 into engagement with the lower ply B on the bottom of the separator plate.

Air is delivered from line 205 via line 219 to the left-hand actuator of valve VB after a relatively short time delay introduced by the flow control 219, thereby actuating valve VB to deliver air via line 223 to the forward end of cylinder CB and to vent the rearward end of cylinder CB via line 221. The piston rod of cylinder CB is thereupon retracted to pull the clamp 117 (now open) back to its retracted position at the left of the table top, leaving the leading ends of plies A and B clamped down by the presser foot 27 of the sewing machine and by the wheels 33 and 35 in the contour guide means 7.

As the rearward loading clamp 119 reaches the end of its traverse toward the right, valve 283 is actuated and, since valve 281 is in its actuated condition as a result of frame 165 being in its forward position, air is delivered via line 279 to the right-hand actuator of valve VI. This sets valve VI to deliver air under pressure via line 243 to the rearward end of cylinder CI and to vent the forward end of this cylinder via line 289. The piston rod of cylinder CI is thereby extended to swing the upper jaw 81 of the work clamp 11 down to clamp the trailing ends of plies A and B against the lower jaw 79 of the work clamp.

Air is delivered from line 243 via line 241 to the left-hand actuator of valve VD. This resets valve VD to deliver air via line 245 to the forward ends of cylinders CD1 and CD2 and to vent their rearward ends, thereby retracting their piston rods 179 to raise the pads 177 and release the trailing ends of the plies, thus opening clamp 119 to enable its retraction.

Air is delivered from line 245 via line 277 to the left-hand actuator of valve VH. This sets valve VH to deliver air via line 253 to the rearward end of cylinder CH and to vent the forward end of this cylinder, thereby extending the piston rod CHR of this cylinder to traverse carriage 161 and the rearward loading clamp 119 (now open) back to the left.

Air is delivered from line 253 via line 249 to the left-hand actuator of valve VE. This sets valve VE to deliver air via line 257 to the forward end of cylinder CE and to vent the rearward end of this cylinder, thereby retracting the piston rod of cylinder CE to pull the frame 165 carrying the rearward loading clamp 119 back up to its starting position of FIG. 1 (and FIG. 8).

Air is delivered from line 257 via line 291 including the time delay 295 to the right-hand actuator of valve VJ. This sets valve VJ to deliver air via line 299 to the forward end of cylinder CJ1 and to the rearward end of cylinder CJ2, and to vent air via line 263 from the rearward end of cylinder CJ1 and the forward end of cylinder CJ2. The piston rod of cylinder CJ1 is thereupon retracted to retract the latch 97 and the piston rod of cylinder CJ2 is retracted to actuate the clutch for starting the sewing machine 3 in operation.

With the sewing machine in operation, its feed dogs 25 feed the plies A and B through the sewing machine under the presser foot 27 for being stitched together along their right-hand edge by the needle N. As the plies A and B are fed forward, their trailing ends remain clamped in the work clamp 11 and the plies pull the work clamp up in an arcuate path above the curved portion 21b of the table top centered in the axis 23 via the swinging of arm 63 on this axis. With the weight 93 on the lower end of the arm 63 biasing the arm 63 to swing downward, the work clamp 11 is in effect biased rearward with the result that the plies are fed forward through the sewing machine under tension, as is desirable. The pneumatic edge sensor 17 senses the position of the right-hand edges of the plies as they enter the contour guide means (some distance upstream from the guide wheels 33 and 35 and pneumatic edge sensors 41 and 45) and acts via the air proportioning device 337, cylinder 101 and linkage 105 to shift the work clamp 11 from side-to-side generally to align the edges of the plies with the wheels 33 and 35 and sensors 41 and 45 of the contour guide means as the plies enter the contour guide means. With the right-hand edges of the plies A and B passing over and under the separator plate 31 generally aligned with the wheels 33 and 35, the plies are properly presented to the wheels to avoid wrinkling of the plies or other problems such as might otherwise result from the inertia of the mass of the plies.

As the work clamp 11 approaches the separator plate 31 of the contour guide means 7, the arm 63 actuates valve 271, resulting in delivery of air via line 269 to the left-hand actuator of valve VG. This resets valve VG to deliver air via line 231 to the rearward end of cylinder CG and to vent the forward end of this cylinder via line 273. The piston rod of cylinder CG is thereupon retracted to swing the separator plate off to the right to its retracted position clear of the oncoming work clamp 11.

Air is delivered from line 231 via line 229 to the left-hand actuator of valve VC, resetting this valve to deliver air via line 233 to the rearward side of cylinders CC1 and CC2 and to vent the forward ends of these cylinders via line 235. the piston rods of cylinders CC1 and CC2 are thereupon retracted to raise the upper guide wheel 33 and lower the lower guide wheel 35 to clear the way for the oncoming work clamp 11.

The work clamp 11, clamping the trailing ends of the plies A and B with these ends matched, continues its forward movement (under the pull of the plies A and B resulting from the feed of the plies through the sewing machine by the feed dogs) and travels on to a point where the forward end of the clamp is closely adjacent the presser foot of the sewing machine. At this point, valve 287 is actuated by the arm 63 (which carries the clamp 11), resulting in delivery of air via line 285 to the left-hand actuator of valve VI and also to the left-hand actuator of valve VJ via line 293 including the time-delay means 297. This resets valve VI to deliver air via line 289 to the forward end of cylinder C1 and to vent the rearward end of this cylinder via line 243. The piston rod of cylinder C1 is thereupon retracted to open the work clamp 11 (by swinging up its movable upper jaw 81), releasing the trailing ends of the plies A and B so that they may be fed on through the sewing machine and sewn to the very end. After the delay imposed by means 297, valve VJ is reset to deliver air via line 263 to the rearward end of cylinder CJ1 and the forward end of cylinder CJ2, and to vent the forward end of cylinder CJ1 and the rearward end of cylinder CJ2 via line 299. This extends the piston rod of cylinder CJ1 to reset the latch 97 and retracts the piston rod of cylinder CJ2 to deactuate the clutch to stop the sewing operation. Upon opening of the work clamp 11 and the release of the trailing ends of the plies A and B, the arm 63 carrying the work clamp swings back down to the starting position and is re-latched by the latch 97. Air is delivered from line 263 via lines 261 and 267 to the right-hand actuator of valve VG. This sets valve VG to deliver air via line 273 to the rearward end of cylinder CG and to vent its forward end via line 231. The piston rod of cylinder CG is thereupon extended to return the separator plate 31 to its operative position. Air is also delivered via line 261 to the left-hand actuator of valve VF, thereby actuating valve VF to deliver air under pressure via line 265 to the forward end of cylinder CF and to vent the rearward end of cylinder CF via line 227. The piston rod of cylinder CF is thereupon retracted to raise the presser foot 27. This completes the resetting of the various components to their starting position ready for the next cycle of operation.

It will be observed that when the leading ends of the assembly of plies A and B have been entered in the sewing machine and the trailing ends of the plies have been clamped in the work clamp 11 to start a sewing operation on the plies, the first or forward loading clamp 117 opens and returns to its FIG. 1 starting position at the left of the apparatus, and the second or rearward loading clamp 119 opens and returns to its FIG. 1 starting position. Thus, while the stated assembly of plies is being sewn, the next assembly of plies to be sewn may be loaded into the loading means 61, by placement of the leading ends of the plies of this next pair in clamp 117 and operation of valve 203 to close clamp 117, and by placement of the trailing ends of the plies of this next pair in clamp 119. Then, as the sewing of the first-stated assembly is completed, valve 239 may be actuated to start the cycle of operation on said next assembly involving its entry at its leading end in the sewing machine and at its trailing end in the control clamp 11 and the feeding thereof through the sewing machine with contour guidance for contour seaming.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for joining plies of material such as textile fabric comprising means for seaming the plies together along an edge thereof, means for feeding the plies through the seaming means, and contour guide means for shifting the plies as they are fed forward by the feeding means to effect contour seaming of the plies, wherein the improvement comprises the provision of means for controlling the feed of the plies, said control means comprising a control clamp for clamping the plies as they are fed forward and means mounting said control clamp for movement with the plies as they are fed forward, and loading means adapted, while one assembly of plies is being fed through the seaming means, to receive the next assembly of plies to be seamed and operable upon completion of seaming of the said one assembly to enter the next assembly in the seaming means and in said control clamp.

2. Apparatus as set forth in claim 1 wherein said loading means comprises a first loading clamp for clamping the plies at their leading ends and a second loading clamp for clamping the plies away from their leading ends, means for moving said first loading clamp from a ply-receiving position toward the seaming means to enter the leading ends of the plies in the seaming means, and means for moving the second loading clamp from a ply-receiving position to enter the plies in said control clamp.

3. Apparatus as set forth in clamp 1 wherein said control clamp is biased in the direction away from the seaming means to tension the plies clamped by said control clamp as the plies feed forward through the seaming means.

4. Apparatus as set forth in claim 3 wherein the control clamp is adapted to clamp the plies at their trailing ends and the loading means is movable to enter the trailing ends of the plies in the control clamp.

5. Apparatus as set forth in claim 4 having means determining a starting position of the control clamp and means for moving the loading means to enter the trailing ends of the plies in the control clamp with the latter in its starting position.

6. Apparatus as set forth in claim 5 wherein the loading means comprises a first loading clamp for clamping the plies at their leading ends and a second loading clamp for clamping the plies adjacent their trailing ends, means for moving said first loading clamp from a retracted ply-receiving position toward the seaming means to enter the leading ends of the plies in the seaming means, and means for moving the second loading clamp from a ply-receiving position to enter the trailing ends of the plies in said control clamp.

7. Apparatus as set forth in claim 6 wherein the first loading clamp is movable laterally from a retracted ply-receiving position to one side of the seaming means in the direction toward the seaming means to enter the leading ends of the plies in the seaming means, and the second loading clamp is movable laterally and rearwardly from a retracted ply-receiving position rearward of the first loading clamp to enter the trailing ends of the plies in said control clamp.

8. Apparatus as set forth in claim 1 wherein the mounting means for the control clamp, in addition to mounting it for forward movement with the plies as they are fed forward also mounts it for side-to-side movement relative to the direction of feed, and wherein means is provided for shifting the control clamp from side to side as it moves forward to align the edges of the plies with the contour guide means as the plies enter the latter.

9. Apparatus as set forth in claim 8 having a sensor for sensing the position of the edges of the plies as they enter the contour guide means and controlling the shift means for the control clamp.

10. Apparatus as set forth in claim 8 wherein the mounting means for the control clamp mounts the control clamp for angling relative to the direction of feed as the control clamp is moved from side to side generally to maintain the control clamp directed toward the seaming means.

11. Apparatus as set forth in claim 10 wherein said loading means comprises a first loading clamp for clamping the plies at their leading ends and a second loading clamp for clamping the plies away from their leading ends, means for moving said first loading clamp from a ply-receiving position toward the seaming means to enter the leading ends of the plies in the seaming means, and means for moving the second loading clamp from a ply-receiving position to enter the plies in said control clamp.

12. Apparatus as set forth in claim 10 wherein said control clamp is biased in the direction away from the seaming means to tension the plies clamped by said control clamp as the plies feed forward through the seaming means.

13. Apparatus as set forth in claim 12 wherein the control clamp is adapted to clamp the plies at their trailing ends and the loading means is movable to enter the trailing ends of the plies in the control clamp.

14. Apparatus as set forth in claim 13 having means determining a starting position of the control clamp and means for moving the loading means to enter the trailing ends of the plies in the control clamp with the latter in its starting position.

15. Apparatus as set forth in claim 14 wherein the loading means comprises a first loading clamp for clamping the plies at their leading ends and a second loading clamp for clamping the plies adjacent their trailing ends, means for moving said first loading clamp from a retracted ply-receiving position toward the seaming means to enter the leading ends of the plies in the seaming means, and means for moving the second loading clamp from a ply-receiving position to enter the trailing ends of the plies in said control clamp.

16. Apparatus as set forth in claim 15 wherein the first loading clamp is movable laterally from a retracted ply-receiving position to one side of the seaming means in the direction toward the seaming means to enter the leading ends of the plies in the seaming means, and the second loading clamp is movable laterally and rearwardly from a retracted ply-receiving position rearward of the first loading clamp to enter the trailing ends of the plies in said control clamp.

17. Apparatus as set forth in claim 10 wherein the mounting means for the control clamp, in addition to mounting it for forward movement with the plies as they are fed forward also mounts it for side-to-side movement relative to the direction of feed, and wherein means is provided for shifting the control clamp from side to side as it moves forward to align the edges of the plies with the contour guide means as the plies enter the latter.

18. Apparatus as set forth in claim 17 having a sensor for sensing the position of the edges of the plies as they enter the contour guide means and controlling the shift means for the control clamp.

19. Apparatus as set forth in claim 17 wherein the mounting means for the control clamp mounts the control clamp for angling relative to the direction of feed as the control clamp is moved from side to side generally to maintain the control clamp directed toward the seaming means.

20. Apparatus as set forth in claim 1 for sewing together two plies of material wherein the seaming means comprises a sewing machine, the contour guide means comprises a plate adjacent the sewing machine over which one ply and under which the other ply are fed to the sewing machine, an upper wheel above the plate for shifting the upper ply, a lower wheel below the plate for shifting the lower ply and means for raising and lowering each wheel, and wherein the control clamp is movable up to the sewing machine and means is provided for raising the upper wheel, lowering the lower wheel and moving the separator plate out of the way of the control clamp as it approaches the sewing machine.

21. Apparatus as set forth in claim 20 having means for opening the control clap when it reaches the sewing machine to release the plies.

22. Apparatus for joining plies of material, such as textile fabric, comprising means for seaming the plies together along an edge thereof, means for feeding the plies through the seaming means, and contour guide means for shifting the plies as they are fed forward by the feeding means to effect contour seaming of the plies, wherein the improvement comprises the provision of means for controlling the feed of the plies to the contour guide means, said control means comprising a control clamp for clamping the plies as they are fed forward, means mounting the clamp for movement with the plies as they are fed forward and also for side-to-side movement relative to the direction of feed, means for sensing the position of the edge of the plies as the plies approach the contour guide means, and means responsive to said sensing means for shifting said clamp from side to side as it moves forward generally to align the edge of the plies with the contour guide means as the plies enter the latter.

23. Apparatus as set forth in claim 22 for sewing together two plies of material wherein the seaming means comprises a sewing machine, the contour guide means comprises a plate adjacent the sewing machine over which one ply and under which the other ply are fed to the sewing machine, an upper wheel above the plate for shifting the upper ply, a lower wheel below the plate for shifting the lower ply and means for raising and lowering each wheel, and wherein the control clamp is movable up to the sewing machine and means is provided for raising the upper wheel, lowering the lower wheel and moving the separator plate out of the way of the control clamp as it approaches the sewing machine.

24. Apparatus as set forth in claim 23 having means for opening the control clamp when it reaches the sewing machine to release the plies.

25. Apparatus as set forth in claim 22 wherein said clamp mounting means comprises a first bar extending transversely of the apparatus movable toward and away from the seaming means, said first bar being a fixed bar of a four-bar linkage comprising second and third bars extending forward from said first bar and pin-connected at their rearward ends to said first bar, and a fourth bar pin-connected to the forward ends of the second and third bars, said clamp being carried by said fourth bar, and said shifting means being operable to swing the side bars from side to side on their pin connections to the first bar.

26. Apparatus as set forth in claim 25 wherein the pin connections of the second and third bars to the fourth bar are spaced a distance less than their pin connections to the first bar.

27. Apparatus as set forth in claim 1 comprising a table over which the plies are fed to the seaming means, the top of the table having a forward portion and a rearward portion, the rearward portion being curved in an arc centered in an axis extending transversely of the table below the top, the mounting means for the control clamp comprising supporting means for the control clamp pivoted for swinging movement on said axis and having a part extending over the table carrying said control clamp.

28. Apparatus as set forth in claim 27 wherein said seaming means comprises a sewing machine mounted at one side of the forward portion of the table top, said loading means comprising a first loading clamp for clamping the plies at their leading ends and a second loading clamp for clamping the plies at their trailing ends, said first loading clamp being movable from a ply-receiving position at the other side of said forward portion of the table top toward the sewing machine to enter the leading ends of the plies in the sewing machine and the contour guide means, the second loading clamp being carried by means pivoted for swinging movement on said axis and movable on said means away from and back to a ply-receiving position at said other side of the table top.

29. Apparatus as set forth in claim 28 having means for opening said first loading clamp upon entry of the leading ends of the plies in the seaming means and for opening said second loading clamp upon entry of the trailing ends of the plies in said control clamp.

* * * * *